US007301459B2

(12) United States Patent
Frederick et al.

(10) Patent No.: US 7,301,459 B2
(45) Date of Patent: Nov. 27, 2007

(54) CLOSED LOOP TRANSMITTER CONTROL FOR POWER AMPLIFIER IN AN EAS SYSTEM

(75) Inventors: Thomas J. Frederick, Coconut Creek, FL (US); Richard L. Herring, Wellington, FL (US); Jeffrey T. Oakes, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 221 days.

(21) Appl. No.: 11/121,897

(22) Filed: May 4, 2005

(65) Prior Publication Data

US 2005/0253719 A1 Nov. 17, 2005

Related U.S. Application Data

(60) Provisional application No. 60/570,032, filed on May 11, 2004.

(51) Int. Cl.
*G08B 13/14* (2006.01)

(52) U.S. Cl. ..... 340/572.4; 340/572.1; 340/568.1

(58) Field of Classification Search ..... 340/568.1, 340/571, 572.1, 572.2, 572.4, 572.6, 539.1, 340/10.1, 10.3; 375/239, 259; 455/119, 455/126; 343/742

See application file for complete search history.

(56) References Cited

U.S. PATENT DOCUMENTS

| | | | | |
|---|---|---|---|---|
| 4,859,991 | A * | 8/1989 | Watkins et al. | 340/572.2 |
| 5,103,234 | A * | 4/1992 | Watkins et al. | 343/742 |
| 5,742,189 | A * | 4/1998 | Yoshida et al. | 327/113 |
| 5,764,697 | A * | 6/1998 | Sakuma et al. | 375/239 |
| 5,812,941 | A * | 9/1998 | Cho | 455/126 |
| 6,970,518 | B2 * | 11/2005 | Kuffner et al. | 375/259 |

* cited by examiner

*Primary Examiner*—Van T. Trieu
(74) *Attorney, Agent, or Firm*—Dean D. Small; The Small Patent Law Group

(57) ABSTRACT

A method for controlling operation of a transmitter in an electronic article surveillance (EAS) system is described that includes coupling each of a plurality of transmit channels to a corresponding antenna, configuring a modulator within each transmit channel to output a modulated signal to the corresponding antenna, providing feedback of each modulated signal, and adjusting operation of each modulator based on the feedback. An EAS transmitter and an EAS system are also described.

20 Claims, 5 Drawing Sheets

CLOSED LOOP TRANSMITTER CONTROL FOR POWER AMPLIFIER IN AN EAS SYSTEM

CROSS REFERENCE TO RELATED APPLICATIONS

The present application relates to and claims priority from Provisional Application Ser. No. 60/570,032, filed May 11, 2004, titled "Closed Loop Transmitter Control for Switching Acoustic-Magnetic Power Amplifier in an EAS System", the entire disclosure of which is hereby incorporated by reference herein in its entirety.

BACKGROUND OF THE INVENTION

1. Field of the Invention

This invention relates generally to signal generation within an electronic article surveillance system and, more particularly, to a system and method for amplifier control within a transmitter configured to transmit signals for reception by EAS tags.

2. Description of the Related Art

In acoustomagnetic or magnetomechanical electronic article surveillance, or "EAS," a detection system may excite an EAS tag by transmitting an electromagnetic burst at a resonance frequency of the tag. When the tag is present within the electromagnetic field created by the transmission burst, the tag begins to resonate with an acoustomagnetic or magnetomechanical response frequency that is detectable by a receiver in the detection system.

Transmitters used in these detection systems may include linear amplifiers using feedback control or switching amplifiers using open loop control. Linear amplifiers provide good transmitter current regulation with feedback control, but are expensive because of poor power efficiency, typically around forty-five percent (45%). Previous switching amplifiers provide good power efficiency, typically around eighty-five percent (85%), but transmitter current levels can fluctuate due to the open loop control and variable load conditions.

Controller components of the prior art attempt to mitigate this current fluctuation by providing a low bandwidth pulse width adjustment based on measured currents from previous transmission bursts. In one example, further described below with respect to FIGS. 1 and 2, transmitter component hardware provides a single pulse width modulator that controls a single half bridge amplifier with multiple loads connected in parallel across the amplifier output. In this configuration, the antenna with the lowest impedance receives more current than antennas with higher impedance, resulting in different levels of transmission, or power, being output from each of the antennas. Furthermore, the current sensing hardware in such prior art systems is such that only the current supplied to a single load can be sensed at any given time. Specifically, the current applied to a load is estimated after the entire transmission burst is completed by averaging the current samples.

BRIEF DESCRIPTION OF THE INVENTION

In one embodiment, a method for controlling a transmitter in an electronic article surveillance system is provided. The method may comprise coupling each of a plurality of transmit channels of the transmitter to a corresponding antenna, configuring a modulator within each transmit channel to output a modulated signal to the corresponding antenna, providing feedback of each modulated signal, and adjusting operation of each modulator based on the feedback.

In another embodiment, a transmitter for an electronic article surveillance system is provided. The transmitter may comprise a plurality of antennas configured for transmission of signals and a plurality of transmit channels. Each transmit channel is coupled to a corresponding one of the antennas, and each comprises an amplifier configured to supply a signal to its antenna, a modulator configured to supply a modulated signal to the amplifier, a sensing circuit configured to sense an amount of current applied to the antenna by the amplifier, and a controller configured to receive the sensed current amount from the sensing circuit. The controller is configured to control operation of the modulator based on the sensed current amount.

In another embodiment, an electronic article surveillance system is provided that may comprise at least one tag, at least one receiver configured to receive emissions from the tag, and at least one transmitter comprising a plurality of transmit channels. Each transmit channel may be configured to transmit signals to cause the tag to resonate when the tag is in a vicinity of the transmit channel. Each transmit channel may be independently configured to utilize feedback to control an output power of the transmit channel.

BRIEF DESCRIPTION OF THE DRAWINGS

For a better understanding of various embodiments of the invention, reference should be made to the following detailed description which should be read in conjunction with the following figures wherein like numerals represent like parts.

DETAILED DESCRIPTION OF THE INVENTION

For simplicity and ease of explanation, the invention will be described herein in connection with various embodiments thereof. Those skilled in the art will recognize, however, that the features and advantages of the invention may be implemented in a variety of configurations. It is to be understood, therefore, that the embodiments described herein are presented by way of illustration, not of limitation.

Figure 1:
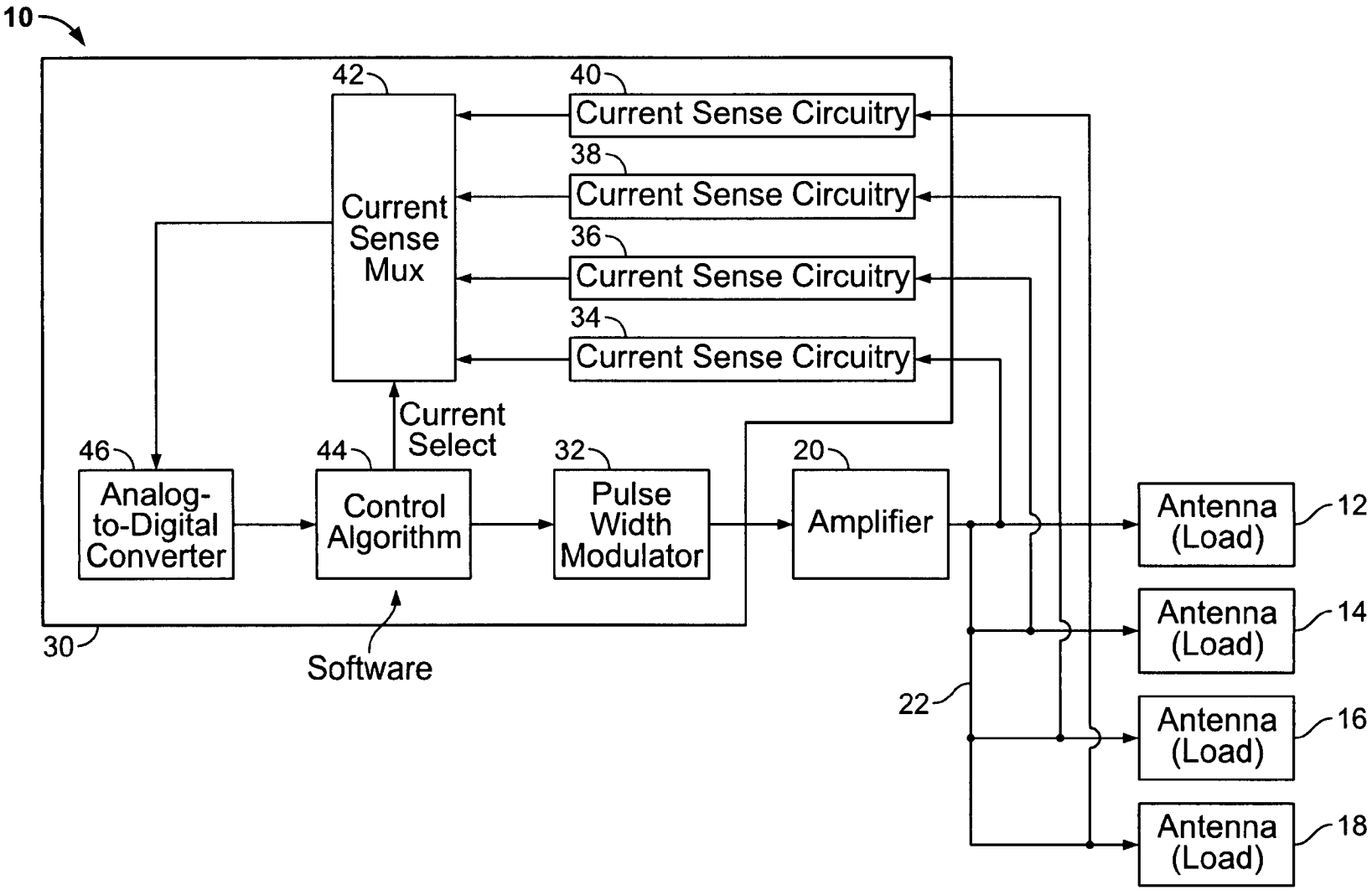
FIG. 1 (Prior Art)
FIG. 1 is a block diagram of a known transmitter utilized in electronic article surveillance (EAS) systems.

FIG. 1 is a block diagram of a transmitter 10 for an electronic article surveillance (EAS) system. Specifically, the transmitter 10 may include a plurality of antennas 12, 14, 16, and 18 respectively, that transmit a signal received from an amplifier 20. A controller 30 within the transmitter 10 may be configured to provide a low bandwidth pulse width adjustment based on current measurements taken during previous transmission bursts. In this embodiment, as illustrated in FIG. 1, the controller 30 may include a single pulse width modulator 32 that controls the amplifier 20, which in one embodiment, may be a single half bridge amplifier, with the antennas 12, 14, 16, and 18 connected in parallel across amplifier output 22.

To provide control of the pulse width modulator 32, current sense circuits 34, 36, 38, and 40 respectively, may be electrically connected to each respective antenna 12, 14, 16, and 18 and configured to sense an amount of current delivered to each respective antenna 12, 14, 16, and 18. The current sense circuits 34, 36, 38, and 40 each provide a measure of current applied to the antennas 12, 14, 16, and 18 to a muxing circuit 42. The muxing circuit 42 may be controlled by a control algorithm component 44. The control algorithm component 44 determines which current sense circuit output is to be switched through muxing circuit 42 for processing by an analog-to-digital converter 46. Therefore, and in a sequence controlled by the control algorithm component 44, an amount of current applied to each antenna 12, 14, 16, and 18 is fed back through the A/D converter 46 and the control algorithm component 44 to control operation of the pulse width modulator 32.

However, in such a configuration the antennas 12, 14, 16, and 18 function as a current divider, and the antenna with the lowest impedance receives more current than the antennas having higher impedances. The result is that each antenna 12, 14, 16, and 18 typically has a slightly different impedance and therefore transmits a different amount of power. This may be undesirable in an EAS system transmitter. Furthermore, the current sensing hardware in such a system (i.e., the current sense circuits 34, 36, 38, and 40 and the muxing circuit 42) is such that only the current applied to a single load (antenna) can be sensed at any one time. The current applied to each load is estimated after the transmission burst is completed by averaging the current samples received at the control algorithm 44.

Figure 2:
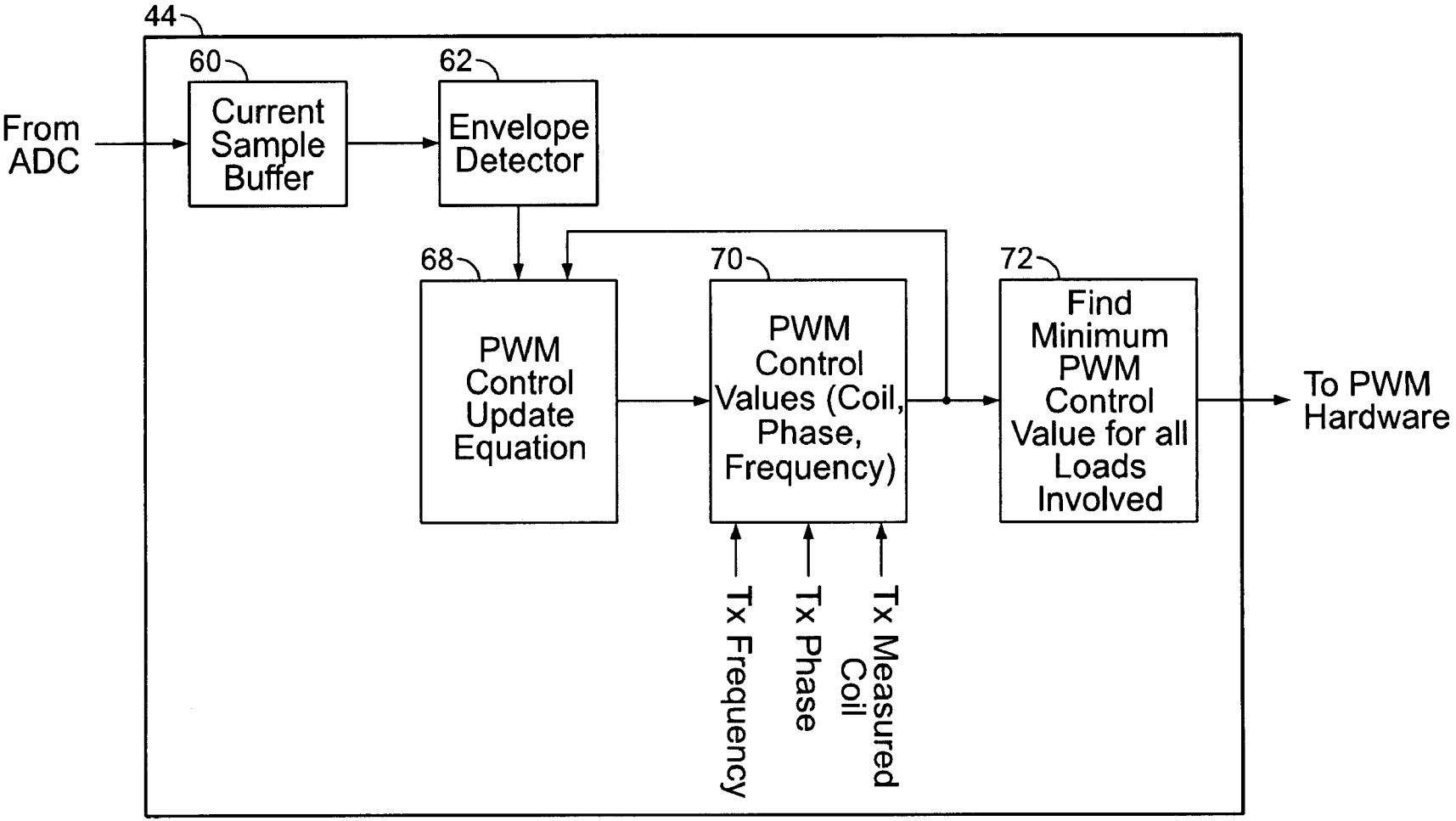
FIG. 2 (Prior Art)
FIG. 2 is a block diagram of a control function utilized within the transmitter of FIG. 1.

FIG. 2 is a block diagram illustrating the functionality of the control algorithm component 44. Specifically, a sample buffer 60 receives samples of the sensed current that is applied to the antennas 12, 14, 16, and 18 from the A/D converter 46 (all shown in FIG. 1). As described above, sample buffer 60 receives samples relating to a single one of antennas 12, 14, 16, and 18 at any one time. The samples are then processed to determine an amplitude of the samples by a envelope detector 62 as is known.

The amplitude of the sensed current sample is then input into a pulse width modulator control update equation 68. The pulse width modulator (PWM) control values 70 receives inputs relating to a transmit frequency, phase of the transmit signal, and a desired current output of the PWM hardware. A calculation component 72 may be configured to determine minimum PWM control values 70, sometimes referred to as state variables, for the loads being driven by the PWM hardware, via amplifier 20 (shown in FIG. 1).

Figure 3:
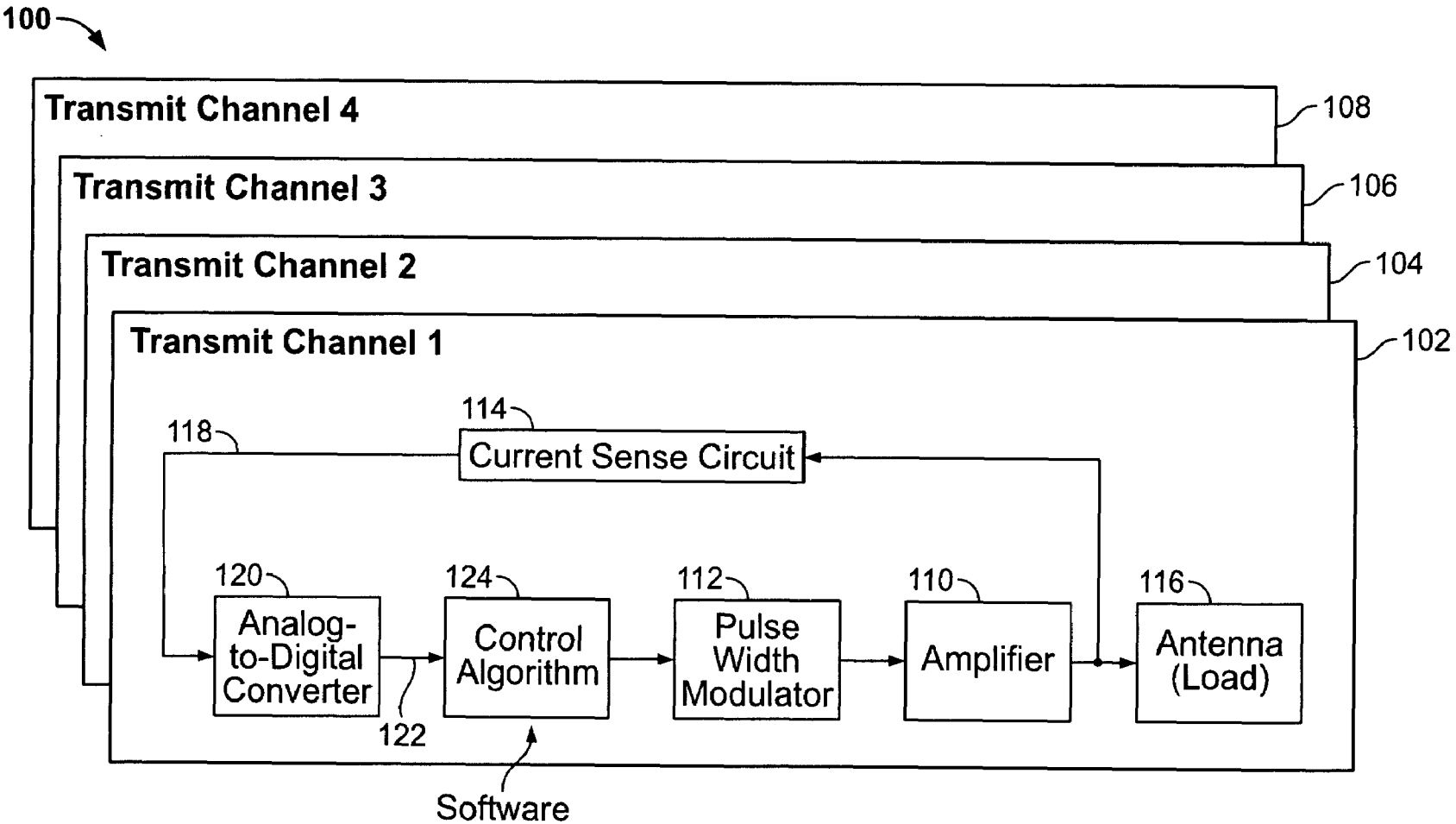
FIG. 3 is a block diagram of a transmitter incorporating independent feedback control for each antenna load constructed in accordance with an exemplary embodiment of the invention.

FIG. 3 is an illustration of an embodiment of a multiple channel transmitter 100 for an EAS system that addresses the different antenna impedances and resultant variations in transmit power described above. In the illustrated embodiment, four independent transmitter channels 102, 104, 106 and 108 are illustrated, but it is understood that any number of transmitter channels may be utilized as necessary for a given EAS system application. In addition, while described with respect to transmitter channel 102 below, it is to be understood that transmitter channels 104, 106, and 108 may be similarly configured. In addition, any embodiments that utilize less than or more than four transmitter channels may be similarly configured.

In an exemplary embodiment, the transmitter 100 utilizes real-time feedback control of individual switching power amplifiers. As shown in the illustrated embodiment, each transmitter channel, for example transmitter channel 102, may include an independent switching amplifier 110 provided with real-time feedback control of the pulse width modulator 112. Such a configuration provides the power efficiency and low cost of switching amplifiers, with a level of current regulation similar to that commonly associated with linear amplifiers. Because the power generated within each independent transmitter channel in this embodiment is approximately one fourth the power generated within a transmitter using a single channel (and amplifier) to drive four antennas (e.g., transmitter 10 shown in FIG. 1), the electronic components utilized within transmitter channels 102, 104, 106, and 108, are smaller, dissipate less power, and are less expensive in total than the electronic components utilized in production of transmitter 10.

Referring again to FIG. 3, the transmitter channel 102 may include a current sensing circuit 114 configured to measure, or sense, an amount of current that the amplifier 110 supplies to drive the load provided by antenna 116. In one embodiment, current sensing circuit 114 may be configured to output a voltage. The current sensing circuit 114 provides a feedback signal 118 (e.g., a voltage), which may be input into an analog-to-digital converter (ADC) 120 and converted to a digital signal 122. This digital signal 122 may be input into a control algorithm component 124. Control algorithm component 124, includes, for example, a processing chip, such as a microprocessor, microcontroller or digital signal processor (DSP) and the programming associated therewith. In alternative embodiments, the control algorithm component 124 may be implemented using combinations of discrete electronic components.

Figure 4:
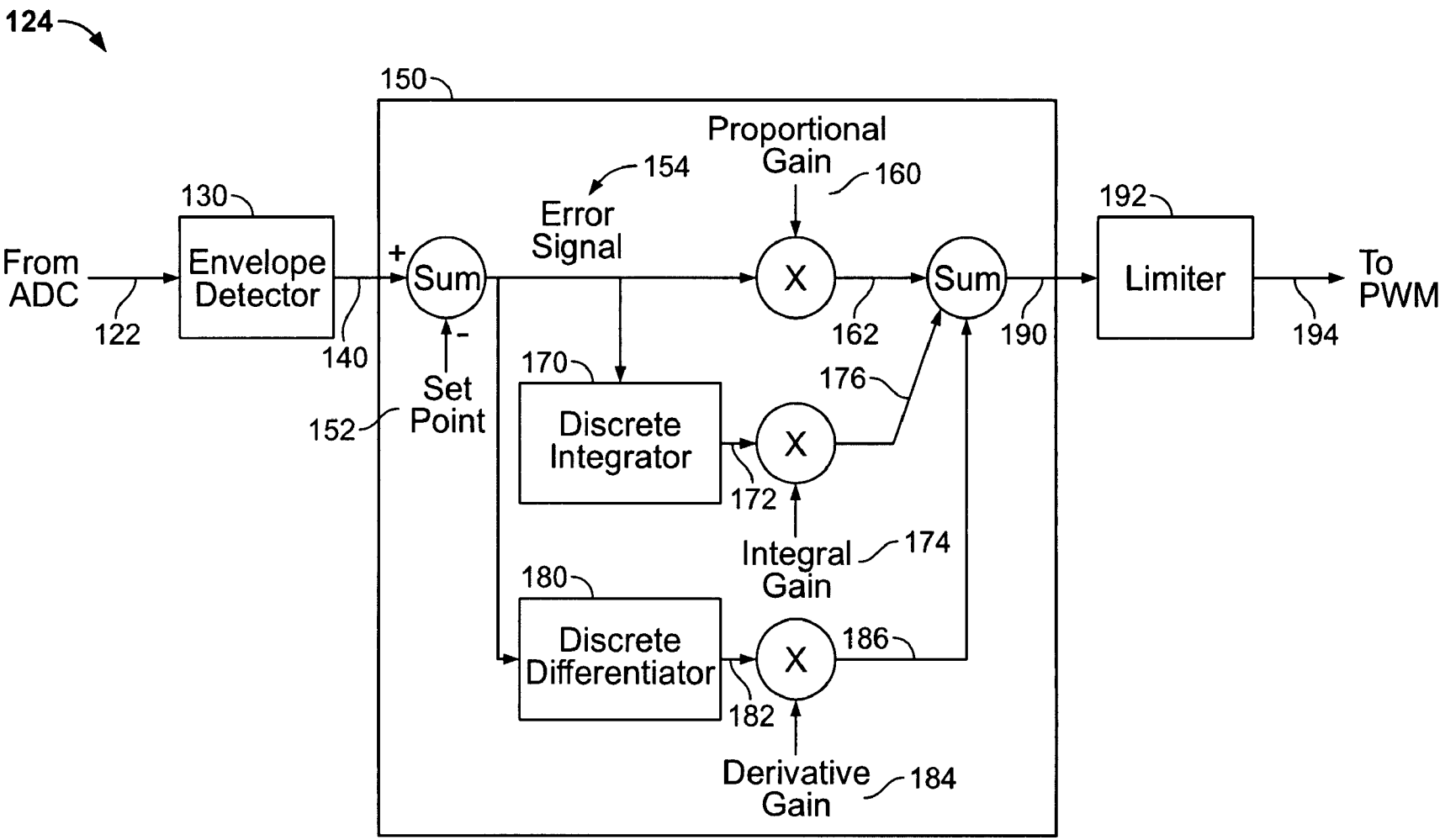
FIG. 4 is a block diagram of an exemplary control function embodiment for use with the transmitter of FIG. 3.

Operation of an embodiment of a control algorithm component 124 is illustrated in FIG. 4. As shown in FIG. 4, the digital signal 122, which is representative of the current sensed at the output of the amplifier 110, may be input into the control algorithm component 124. The control algorithm component 124 may be configured to determine the magnitude of the feedback signal. In the illustrated embodiment, magnitude of the digital signal 122 may be determined using an envelope detector 130 as is known. Those of ordinary skill in the art will appreciate that other known detectors may be used.

In addition, the magnitude of the digital signal 122 (output 140) may be input into a proportional, integral, derivative, or "PID", controller 150. In the embodiment illustrated, a desired current amplitude, represented by set point 152, may be subtracted from the computed current amplitude (output 140), producing an error signal 154. The error signal 154 may then be multiplied by a proportional gain constant 160, or Kp, to produce the proportional control value 162, or Cp. The error signal 154 may also input into an integrator equation, shown as discrete integrator 170 in FIG. 4, whose output 172 is multiplied by the integral gain constant 174, or Ki, to produce the integral control value 176, or Ci. Finally, the error signal 154 may also be input into a differentiator equation, shown as discrete differentiator 180 in FIG. 4, whose output 182 may be multiplied by the derivative gain constant 184, or Kd, to produce the differential control value 186, or Cd.

The three control component values 162, 176, and 186, or Cp, Ci, and Cd, may be summed to produce a overall control value 190, or C. This control value 190 may be limited by a limiting function embodied within limiter 192 to an allowable input range of the pulse width modulator 112. The resulting control signal 194 may be input into the pulse width modulator 112 (shown in FIG. 3). Implementation of discrete integral and differentiator equations on digital signal processors and other processing components generally is known to those skilled in the art. Also, selection of suitable gain constants Kp, Ki, and Kd may be dependent on other parameters of the system, such as variable gains in the current sense circuit 114 and the amplifier 110 due to variations in discrete electronic components.

Although described as a digital signal processor (DSP), the signal processing described herein is capable of being performed on microprocessors, microcontrollers, and other processing topologies, for example, fuzzy and/or neural control structures, observer/estimator or state space control structures, and other topologies, without altering the essence of the embodiments herein described. Also, advances in semiconductor integration have produced a variety of integrated circuits that integrate, for example, muxing, analog to digital conversion, and modulation within a single processor chip.

In operation, the control signal 194 generated by the control algorithm component 124 is therefore based upon an amount of current sensed at the antenna 116 by the current sense circuit 114 (both shown in FIG. 3). This control signal 194 may be input into the pulse width modulator 112 (shown in FIG. 3), which generates a pulse modulated signal having a pulse width dependent upon the parameters of the control signal 194. The pulse modulated signal generated may then be amplified by the amplifier 110 (shown in FIG. 3) and used to drive the transmission antenna 116. The transmission pulse output results in a current applied to the antenna 116. The current may again be sensed by current sensing circuit 114, which provides feedback to the control algorithm component 124. In this way, feedback is utilized to set the width of the transmitted signal pulse output by the amplifier 110.

The EAS system transmitter 100 described with respect to FIGS. 3 and 4 provides independent real-time control of the amount of current applied to multiple antenna loads. As such, an EAS transmitter can be configured so that a desired amount of transmit power can be individually controlled for each antenna of the transmitter 100 through simultaneous, independent, current monitoring of all transmit channels 102, 104, 106, and 108. As compared to, for example, transmitter 10 (shown in FIG. 1), cost of the transmitter is reduced to due semiconductor integration and also due to the reduction in power (both generated and dissipated) associated with separate transmit channels. A net effect of higher integration and smaller, less expensive power components is that the total cost of using multiple independent transmit channels and loads is less than using a single channel to supply power for multiple loads. In addition, the transmitter configurations described herein also result in advantages with respect to circuit protection, thermal management, and current regulation as compared to known transmitter configurations.

Figure 5:
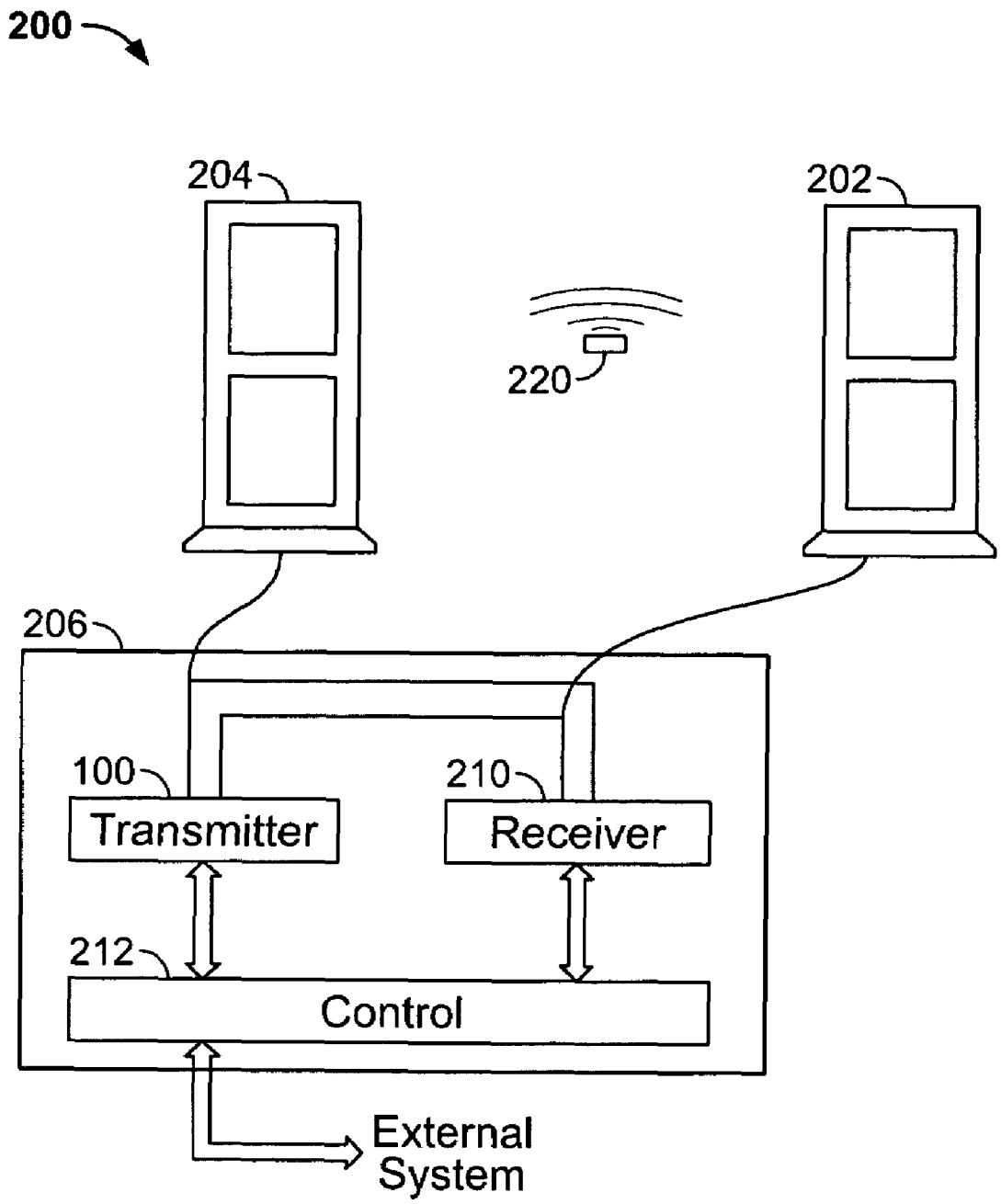
FIG. 5 is a block diagram of an EAS system capable of incorporating the transmitter of FIG. 3.

FIG. 5 is an illustration of an EAS system 200 which is capable of incorporating the embodiments of transmitter 100 described herein. Specifically, EAS system 200 may include a first antenna pedestal 202 and a second antenna pedestal 204, each of which may include a number of antennas (e.g., antenna 16). The antennas within antenna pedestals 202 and 204 may be connected to a control unit 206 that may include transmitter 100 and receiver 210. Within control unit 206 a controller 212 may be configured for communication with an external device. In addition, controller 212 may be configured to control the timing of transmissions from transmitter 100 and expected receptions at receiver 210 such that the antenna pedestals 202 and 204 can be utilized for both transmission of signals to an EAS tag 220 and reception of frequencies generated by EAS tag 220. System 200 is representative of many EAS systems and is meant as an example only. For example, in an alternative embodiment, control unit 206 may be located within one of the antenna pedestals 202 and 204. In still another embodiment, additional antennas which only receive frequencies from the EAS tags 220 may be utilized as part of the EAS system 200. Also a single control unit 206, either within a pedestal or located separately, may be configured to control multiple sets of antenna pedestals.

As a result of incorporating the embodiments described herein, the performance of the transmitters (e.g., transmitter 100) in EAS systems (e.g., EAS system 200) is improved to provide an increase in power efficiency and to allow the independent sensing of multiple antenna loads. At the same time, such transmitters provide reliable transmitter current levels under variable load conditions and also provide redundant fault handling at a low cost.

It is to be understood that variations and modifications of the various embodiments of the present invention can be made without departing from the scope of the invention. It is also to be understood that the scope of the various embodiments of the invention are not to be interpreted as limited to the specific embodiments disclosed herein, but only in accordance with the appended claims when read in light of the forgoing disclosure.

What is claimed is:

1. A method for controlling a transmitter in an electronic article surveillance system, said method comprising:

coupling each of a plurality of transmit channels of the transmitter to a different one of a plurality of corresponding antennas;

configuring a modulator within each transmit channel to output a modulated signal to the corresponding antenna;

providing feedback of each modulated signal; and adjusting operation of each modulator based on the feedback.

2. A method according to claim 1 wherein adjusting operation of the modulator comprises adjusting a width of each pulse modulated signal applied to the corresponding antenna.

3. A method according to claim 1 wherein providing feedback of each modulated signal comprises:

sensing an amount of current applied to the corresponding antenna; and converting the sensed current to a digital value.

4. A method according to claim 1 wherein adjusting operation of the modulator comprises adjusting a width of each pulse modulated signal applied to the corresponding antenna utilizing a proportional, integral, differential controller.

5. A method according to claim 1 wherein adjusting operation of each modulator comprises:

sensing an amount of current applied to the corresponding antenna; and configuring a proportional, integral, differential control function to reduce an error between a magnitude of the sensed current and a desired current value.

6. A method according to claim 1 wherein adjusting operation of each modulator comprises:

sensing an amount of current applied to the corresponding antenna;

configuring a proportional, integral, differential (PID) control function to reduce an error between the sensed current magnitude and a desired current value; and programming the PID control function to output a control value to a limiting function, where the control value is configured to include proportional, integral, and differential components.

7. A transmitter for an electronic article surveillance system comprising:

a plurality of antennas configured for transmission of signals; and a plurality of transmit channels, each of said transmit channels coupled to at least a corresponding one or more of said antennas, each of said transmit channels comprising:

an amplifier configured to provide a signal to the corresponding said antenna;

a modulator configured to provide a modulated signal to said amplifier;

a sensing circuit configured to sense an amount of current applied to said antenna by said amplifier; and a controller configured to receive the sensed current amount from said sensing circuit, said controller configured to control operation of said modulator based on the sensed current amount.

8. A transmitter according to claim 7 wherein said modulator comprises a pulse width modulator.

9. A transmitter according to claim 7 wherein said amplifier comprises a switching amplifier.

10. A transmitter according to claim 7 further comprising an analog-to-digital (A/D) converter, said A/D converter configured to convert the sensed current to a digital value, the digital value received by said controller.

11. A transmitter according to claim 7 wherein said controller comprises a proportional, integral, differential controller.

12. A transmitter according to claim 7 wherein said controller comprises:

a mathematical component configured to determine a magnitude of the sensed current; and a proportional, integral, differential controller configured to receive the sensed current magnitude and reduce an error between the sensed magnitude and a desired current value.

13. A transmitter according to claim 7 wherein said modulator comprises a pulse width modulator and said controller comprises:

a mathematical component configured to determine a magnitude of the sensed current;

a limiting function configured to limit an output of said controller to an allowable range of said pulse width modulator; and a proportional, integral, differential controller configured to receive the sensed current magnitude, reduce an error between the sensed magnitude and a desired current value, and output a control value to said limiting function, the control value including proportional, integral, and differential components.

14. An electronic article surveillance system comprising:

at least one tag;

at least one receiver configured to receive emissions from said tag; and at least one transmitter comprising a plurality of transmit channels, each said transmit channel configured to transmit signals to cause said tag to resonate when said tag is in a vicinity of said transmit channel, each said transmit channel independently configured to utilize feedback to control an output power of said transmit channel.

15. An electronic article surveillance system according to claim 14 wherein each said transmitter channel comprises:

at least one antenna;

a modulator configured to supply a modulated signal to said at least one antenna;

a sensing circuit configured to sense an amount of current applied to said at least one antenna; and a control circuit is configured to receive the sensed current amount from said sensing circuit, said control circuit configured to utilize the sensed current amount to control operation of said modulator.

16. An electronic article surveillance system according to claim 14 wherein said transmit channel comprises a pulse width modulator configured to utilize feedback to control output power of said transmit channel.

17. An electronic article surveillance system according to claim 14 wherein said transmit channel comprises:

a sensing circuit configured to sense an amount of current output by said transmit channel; and an analog-to-digital (A/D) converter, said A/D converter configured to convert the sensed current to a digital value, the digital value utilized to control an output power of said transmit channel.

18. An electronic article surveillance system according to claim 14 wherein said transmit channel comprises:

a modulator;

a sensing circuit configured to sense an amount of current output by said transmit channel; and a proportional, integral, differential controller configured to receive an error signal based on the sensed current amount from said sensing circuit, said control circuit configured to utilize the error signal to control operation of said modulator.

19. An electronic article surveillance system according to claim 14 wherein said transmit channel comprises a proportional, integral, differential controller configured to receive an error signal based on a sensed current magnitude and provide an output configured to reduce the error between the sensed magnitude and a desired current value.

20. An electronic article surveillance system according to claim 14 wherein said transmit channel comprises:

a modulator;

a limiting function configured to limit a control value signal to an allowable range of said modulator; and a proportional, integral, differential controller configured to receive an error signal based on a sensed current magnitude, and output a control value configured to reduce an error between the sensed magnitude and a desired current value to said limiting function, the control value including proportional, integral, and differential components.

* * * * *